US011230138B2

(12) United States Patent
Meahl

(10) Patent No.: US 11,230,138 B2
(45) Date of Patent: Jan. 25, 2022

(54) FLOOR TILE SCORING-CUTTING GUIDE

(71) Applicant: Gregory Lee Meahl, Covina, CA (US)

(72) Inventor: Gregory Lee Meahl, Covina, CA (US)

( * ) Notice: Subject to any disclaimer, the term of this patent is extended or adjusted under 35 U.S.C. 154(b) by 196 days.

(21) Appl. No.: 16/501,507

(22) Filed: Apr. 22, 2019

(65) Prior Publication Data

US 2021/0213774 A1 Jul. 15, 2021

(51) Int. Cl.
*B43L 7/027* (2006.01)
*B25H 7/02* (2006.01)
*E04F 21/00* (2006.01)

(52) U.S. Cl.
CPC ..... *B43L 7/0275* (2013.01); *B25H 7/02* (2013.01); *E04F 21/0076* (2013.01)

(58) Field of Classification Search
CPC ..... B43L 7/0275; E04F 21/0076; B25H 7/02
(Continued)

(56) References Cited

U.S. PATENT DOCUMENTS 1,417,208 A * 5/1922 Shepard ..... B41B 1/00 33/476
4,128,030 A 12/1978 Kundikoff
(Continued)

*Primary Examiner* — Yaritza Guadalupe-McCall

(57) ABSTRACT

A device to be used as tool creating a straightedge for scoring or cutting VCT (vinyl composition tile) or vinyl floor tile, comprising of a triangular plate that has flat and smooth side surface edges to be used as a straightedge guide to draw a utility knife or other apparatus along the edge. On one of the right angle sides of said triangular plate and face, is an elongated bar fence that extends at ninety-degree angle outwardly from said triangular plate and face. An optional T-bar fence constructed as an integral part of the Floor Tile Cutting—Guide extends only a minimal distance and only far enough from the bottom edge in order that the device can lay flat on a floor tile when it is abutted to the edge or laying off to the side of a floor tile. An optional bar fence on one of the right angle straightedge sides is movable up or down in a ninety-degree angle from said plate and face allowing for the bar fence to lay flat on a floor tile or drop down when off to the side and become a fence that can be abutted to the edge of the floor tile. A preferred embodiment along the fore mentioned sides, there are numeral and corresponding measurement markings indicating distance. Along and by the right angle straightedge side, measurement makings indicate the distance from the bar fence and the edge of the floor tile. Along and by the diagonal straightedge side, measurement makings indicate the distance that the right angle straightedge is from the bottom of floor tile being sized. Such measurement markings on the diagonal are parallel and horizontal to the right angle straightedge side that indicate distance right angle straightedge is from the bottom of the floor tile for easy, quick and accurate measuring for sizing, eliminating the need for a tape measure or other measuring device. With optional recessed, indented or even slightly protruding markings, they are a minimal distance away from the edge allowing for an unobstructed and unencumbered flat and smooth side to guide and to draw a utility knife or other such apparatus along the tool edge. With a preferred embodiment, optionally on the flat face or embedded into the plate of said triangle, is a non slip-slide material made preferably of a rubber material, however optionally it can be made of other material such as vinyl or leather that hold the tool firmly and securely in place preventing movement of tool while using it as a scoring or cutting guide. The tool is constructed preferably of a hard cased aluminum, however optionally it can be constructed of any integrally formed material such as any metal or hard plastic that is solid in nature. It is a tool that is lightweight, compact and easily storable.

18 Claims, 3 Drawing Sheets

Figure 2:
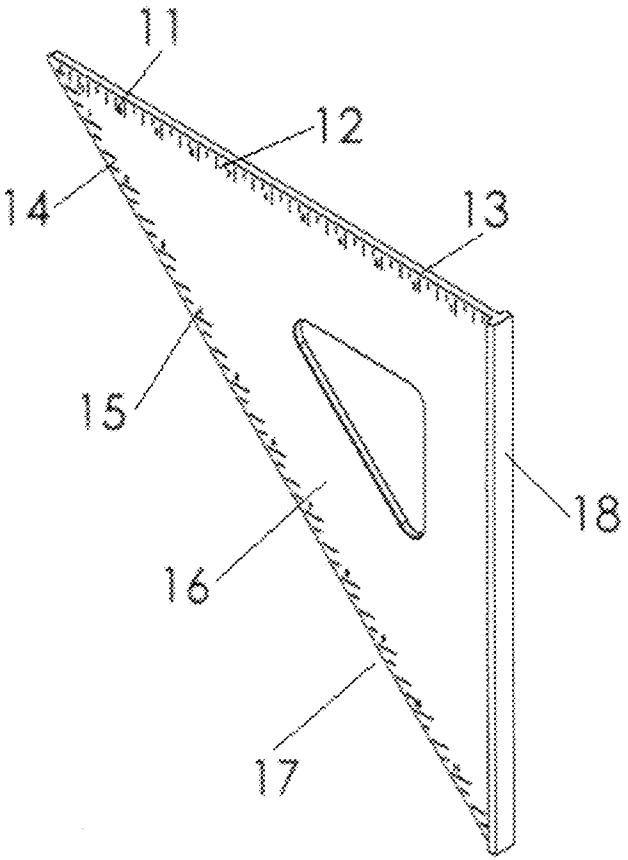

(58) Field of Classification Search
USPC ..... 33/474
See application file for complete search history.

(56) References Cited

U.S. PATENT DOCUMENTS 4,573,276 A 3/1986 Torczon
4,641,435 A * 2/1987 Brown ..... B25H 7/02 33/427
5,170,568 A * 12/1992 Wright ..... B25H 7/02 33/429
5,471,749 A * 12/1995 Brady ..... B26B 29/06 33/484
5,575,074 A 11/1996 Cottongim
5,727,325 A * 3/1998 Mussell ..... B43L 7/027 33/429
5,813,126 A * 9/1998 Dahl ..... B25H 1/0078 33/42
6,070,334 A * 6/2000 Pretsch, Jr. ..... B25H 7/00 248/298.1
6,122,834 A 9/2000 Restrr
6,195,904 B1 * 3/2001 Greer ..... B25H 7/02 33/494
6,289,594 B1 9/2001 Wrobbel
6,393,710 B1 6/2002 Hastings
6,408,529 B1 6/2002 Hodges
6,553,678 B1 4/2003 Austin
6,604,296 B2 * 8/2003 Mastrobattista ..... B23Q 9/0042 30/293
6,725,556 B1 * 4/2004 Graham ..... B25H 7/00 33/429
6,839,974 B1 * 1/2005 Hitchcock ..... B25H 7/00 33/419
6,868,616 B2 * 3/2005 Allemand ..... G01B 3/566 33/476
6,918,189 B1 7/2005 Mcbrrayer
7,066,823 B1 * 6/2006 Bullis ..... A63B 45/02 33/509
7,228,636 B1 6/2007 Moore
7,350,517 B2 * 4/2008 Perez ..... B25H 7/02 125/13.01
7,478,485 B1 1/2009 Rogell
7,854,070 B1 * 12/2010 Vajentic ..... B43L 7/14 33/417
7,882,643 B1 2/2011 Portinen
7,958,646 B2 * 6/2011 So ..... B43L 12/00 33/484
D657,701 S 4/2012 Martinez
8,146,260 B1 * 4/2012 Visser ..... B43L 13/028 33/415
D730,760 S 6/2015 Weaver
2002/0095804 A1 * 7/2002 Coplan ..... B25H 1/0078 33/484
2003/0033724 A1 * 2/2003 Barbosa ..... E04F 21/0076 33/526
2003/0070310 A1 * 4/2003 Werner ..... G01B 5/0014 33/474
2004/0060183 A1 * 4/2004 Moas ..... E04F 21/20 33/526
2004/0172846 A1 9/2004 Mcrae
2004/0200087 A1 * 10/2004 Killen ..... E04D 15/04 33/613
2004/0231175 A1 11/2004 Allemand
2006/0037206 A1 * 2/2006 Sanders ..... G01B 3/566 33/429
2006/0156558 A1 7/2006 Owens
2007/0028474 A1 2/2007 Dickey
2007/0074413 A1 * 4/2007 Neuroth ..... G01B 21/02 33/429
2007/0074414 A1 * 4/2007 Neuroth ..... B43L 7/0275 33/429
2009/0260244 A1 * 10/2009 Carbone, Jr. ..... G01B 3/1084 33/527
2010/0013916 A1 6/2010 Atwood
2010/0139106 A1 * 6/2010 Atwood ..... G01B 3/04 33/418
2010/0154234 A1 * 6/2010 Jarzynka, Jr. ..... G01B 3/566 33/427
2010/0252016 A1 * 10/2010 Flude ..... E04F 21/20 125/1
2012/0285028 A1 * 11/2012 Atwood ..... E04F 21/26 33/452
2021/0213774 A1 * 7/2021 Meahl ..... B43L 7/0275

* cited by examiner

FLOOR TILE SCORING-CUTTING GUIDE

BACKGROUND OF INVENTION

1. Field of Invention

This invention relates to the sizing for installation of VCT (Vinyl Composition Tile) or Vinyl floor tiles to fit on outer or inner edges of a room being installed with floor tiles and the tool used to accomplish the task.

2. Prior Art

Generally when installing VCT floor tile (vinyl composition tile) or Vinyl floor tiles, another floor tile is used as a scoring-cutting guide. When using another tile, not only is setting up the tile square to the edge of the tile to be sized, time consuming and an effort when drawing a utility knife or other apparatus, the pressure against the edge can cause the tile being used to slip or the pressure downward can cause the tile being scored or cut to move out of place. Another method is to use a framing square of which when used has the same drawbacks of using another tile except when abutting one side of the square against the tile to be sized, the scoring-cutting side is raised above the tile being sized making it an effort to line it up to a mark and can allow the utility knife or other apparatus to waver when lying flat on a tile, it can easily slip and slide out of place. Just to measure and mark the tile is time consuming and effort and as well. Another way, is the use of a framing speed square, once again the T-bar extends to far raising the tool edge above the tile having the same disadvantages as a framing square along with the fact that on the diagonal side measurement markings are for angle and not for placement of size. A speed square, just as a framing square, also can easily slip and move out of place. One other disadvantage is recessed markings or slightly protruding markings extend to the edge hampering the utility knife or other apparatus used along the edge. Many other devices can and are used all of which have their drawbacks. All of these methods are generally the most often ways installers use unless you have a tile cutter which are great for cutting straight across. These are expensive tools and the biggest drawback to them is they are not wide enough to cut on a diagonal or tile larger than twelve inches then you and are forced to go with the other methods I previously pointed out. With this invention and tool, not only is it economical, but it makes cutting on the diagonal much simpler and easier. Most floor installers do not want to pay the money for a tile cutter unless they are installing a vast amount of tile. Now, with this invention, even those that are installing a vast amount of tile or a minimal amount, will desire it whether they have a tile cutter or not. With the non-slip face on this invention being in full contact with tile being sized, the tile moving or the guide moving is no longer an issue. This tool is light weight, compact and can easily be stored unlike a tile cutter.

BACKGROUND OF INVENTION—OBJECTS AND ADVANTAGES

Accordingly, besides the objects and advantages of the Floor Tile Scoring-Cutting guide described in my patent, several objects and advantages of the patent invention are:

(a) to provide a tool which can be used as a cutting guide for scoring and cutting Vinyl Composition Tile also known as VCT and vinyl floor tiles.

(b) to provide a tool with flat and smooth side edges creating a straightedge in order to provide a guide for a utility knife or other such apparatus.

(c) to provide a tool with a bar fence that can be abutted to the edge and still the face can lay flat on a floor tile with the other right angle square and diagonal side being a straightedge guide to draw a utility knife or other apparatus along the edge.

(d) to provide a tool for scoring or cutting a floor tile straight across at ninety degrees or on the diagonal and as well be used as a general straightedge for all scoring and cutting needs.

(e) to provide a tool that can be used for measuring, marking and sizing of a floor tile.

(f) to provide a tool wherein markings on the diagonal side are arranged parallel and horizontal to the right angle straightedge side that may be used for sizing floor tile without having to use a tape measure for other device.

(g) to provide a tool with numeral and measurement markings providing for easy alignment on a floor tile.

(h) to provide a tool with a superior surface that that can lay flat on a floor tile and be stable and not move when being used as a scoring or cutting guide.

(i) to provide a tool for sizing floor tiles that are larger than twelve inches in size.

Further objects and advantages is to provide a tool and device more versatile to other devices and methods for the installation of floor tiles which is simple use and fairly inexpensive to manufacture and which can obviate the absolute need for a tape measure or other measuring devices. Still further objects and advantages will become apparent and advantages will become apparent from a consideration of the ensuing description and drawings.

SUMMARY OF INVENTION

With this invention, installing VCT and vinyl floor tile can be accomplished without the drawbacks generally associated with using another floor tile, framing square, speed square or other such apparatus as a scoring or cutting guide. In accordance, a bar fence is on one of the square sides. If a T-bar, it is an integrally constructed as part of the tool and only extends a minimal distance at a ninety-degree angle from plate and face just far enough that the tool can lay flat on a floor tile when abutted to or lying off the edge of a floor tile or an Optional moveable bar fence that is at a ninety-degree angle from the plate and face that allows the entire tool to lay flat on a floor tile or drop down when bar fence is off the edge that can be abutted to a floor tile, thus allowing for either configuration of the tool to easily be aliened to and abutted against the edge of the floor tile to size while the tool lays flat securely in place with full contact on the floor tile. With either T-bar fence or the optional movable fence, the tool can slide freely along the edge of the tile, lining up the other right angle edge and diagonal edge for size or on a mark, can be simply accomplished. With the other right angle and diagonal side, the edges are flat and smooth surfaces creating a straightedge side to draw a utility knife or other such apparatus along the edge. Numeral and corresponding hash markings are placed along the straightedge sides designating measurement. On the right angle straightedge side they designate distance from the edge of bar fence side. On the diagonal side, hash markings are parallel and horizontal from the right angle straightedge scoring-cutting side arranged in a manner in accordance with the length of the bar fence side and determining the actual distance the right angle straightedge side is from the bottom of the floor tile for sizing the tile to be scored or cut and as well can be used as a measuring device. This makes for quick and accurate measurement determining size and the end result and size the tile is to become without the need for a tape measure or other such measuring device. The numerals and corresponding markings on the right angle straightedge side that can be used to determine a stopping point for sizing a cutout around a corner or other obstacle and can be used as well, as a measuring device. In the preferred embodiment, numeral and corresponding hash marks are optionally recessed or indented and set back a minimal distance from the edge of straightedge sides in order to give an unobstructed, unencumbered smooth edge to draw a utility knife or other apparatus along the edge. Another preferred and optional embodiment, on the face or embedded into the plate of the triangle is a non skid-slip material made preferably of a rubber material or other non skid-slip material such as vinyl or leather that holds the tool firmly and securely in place as not to allow utility knife or other apparatus being used, to waver or move from the pressure of drawing the utility knife or other apparatus along the straightedge. Preferably the device is constructed of a hard cased aluminum, however optionally it can be manufactured of any integrally formed material that is solid in nature including plastic or other metal. Not only is this tool time saving but it is economical as well and it makes cutting on the diagonal much simpler and easier. Most floor installers do not want to pay the money for a tile cutter unless they're installing vast amounts of tile or installing tile often. Now with this invention, even those that are installing vast amounts of tile or a minimal amount, will desire it weather they have a tile cutter or not. With the non slip-skid face on this invention the tile moving or the guide moving is no longer an issue as well as lining up on a mark can be precise. The measurement numerals and markings running along the diagonal allow for easy and accurate sizing of the floor tile. With the measurement markings, the need for a tape measure or other measuring device is not critical and marking the tile for ninety-degree parallel scoring or cuts is obsolete. Because this tool lays flat on the tile, being precise is possible. Scoring and cutting tiles that are even two foot square can be accomplished and sized by scoring the length of the tool and simply flipped over and finished.

DRAWINGS

Figure 1:
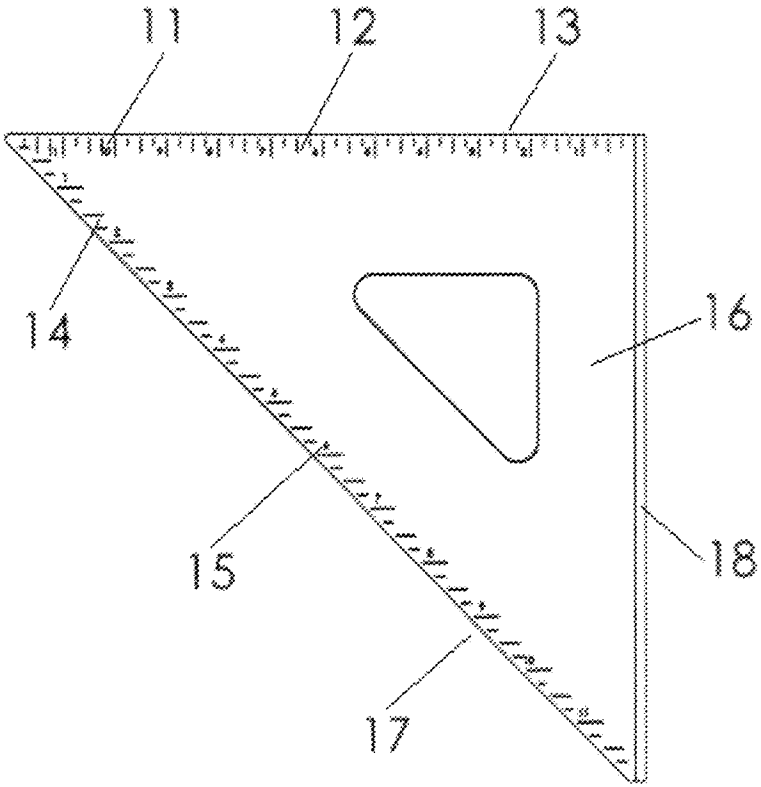

FIG. 1 Shows from a front view and FIG. 2 shows from an isometric view of a basic embodiment of the Tile Scoring-Cutting Guide being a triangular plate with a flat face with measurement numerals and correspondent measurement markings with a bar fence on one of the square right angle sides.

11. Measurement numeral markings along side of the other square right angle side of the bar fence.

12. Indicator measurement hash markings along the other square right angle side of the bar fence.

13. Flat and smooth edge of other right angle square side of the bar fence side creating a straightedge guide.

14. Horizontal parallel indicator measurement markings along diagonal straightedge side for sizing and designating distance right angle straightedge side is from bottom of tile being sized that that are slightly setback from edge.

15. Numeral measurement markings along edge of diagonal straightedge side.

16. Flat face of the triangular plate of the Tile Scoring-Cutting Guide embodiment.

17. Flat and smooth diagonal edge side creating a straightedge guide.

18. The T-bar fence elongated on one side of the right angle triangle wherein that it extends outwardly in a ninety-degree angle from said triangular plate.

Figure 4:
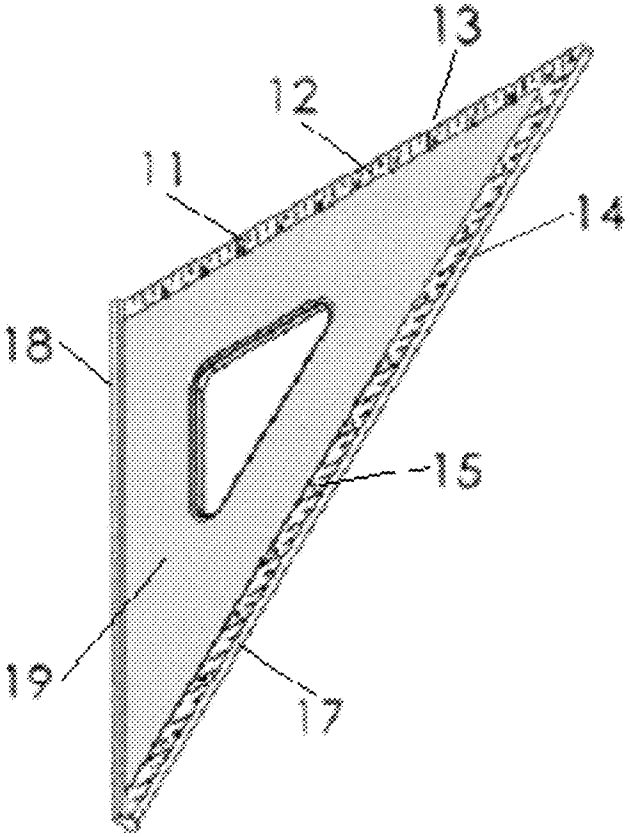
Figure 3:
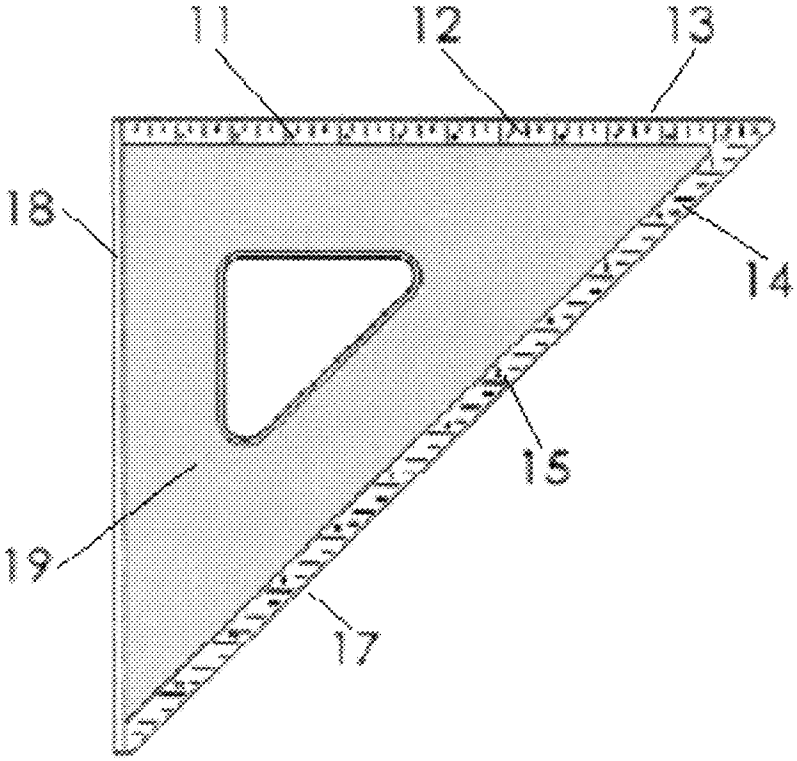

FIG. 3 Shows from a front view and FIG. 4 shows from an isometric view and a preferred embodiment of the Floor Tile Scoring-Cutting Guide of the triangular plate with a flat face and measurement numerals and correspondent measurement markings with a T-bar fence on one of the square right angle sides.

19. Non-skid, non-slip surface attached to the face or embedded into the plate of triangular plate preferably made from a rubber material or other such material, creating a non-skid, non-slip surface to prevent the tool from movement while floor tile is being cut.

Figure 5:
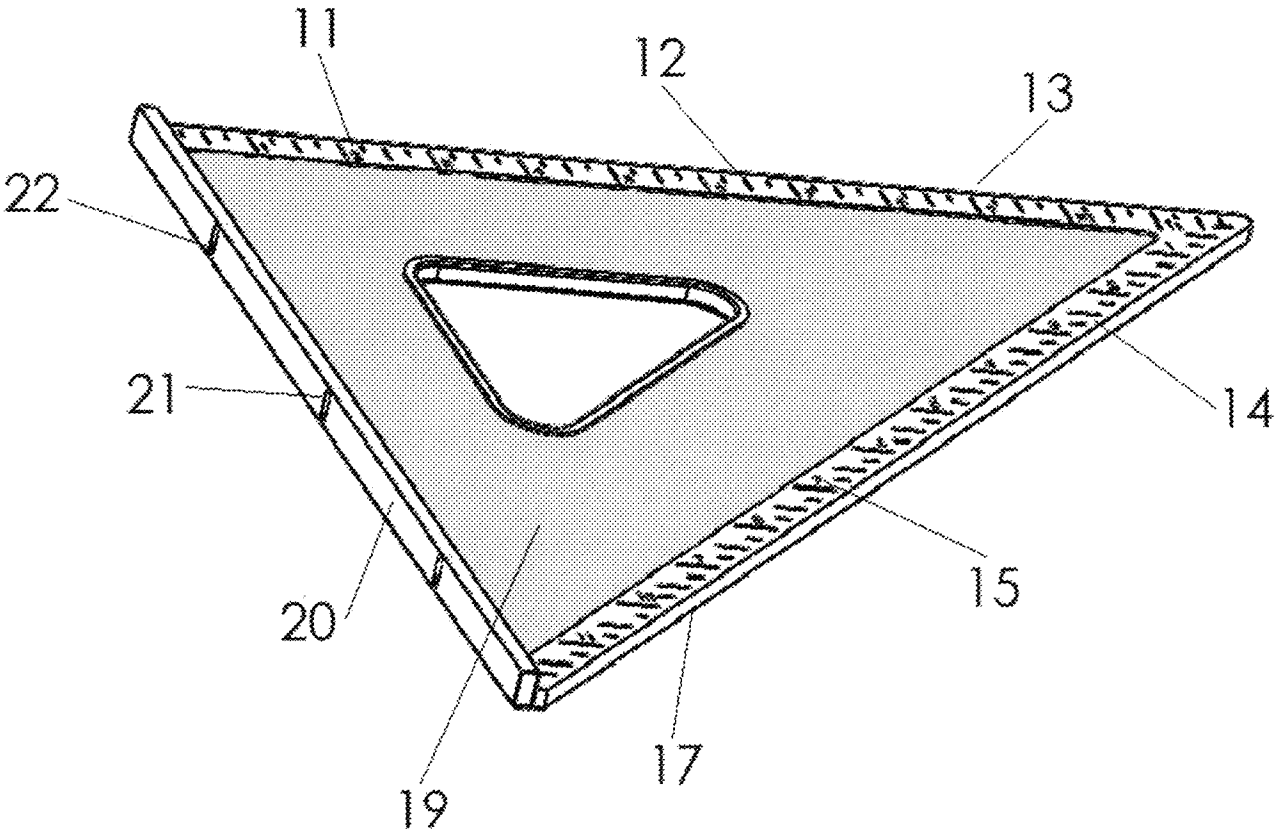

FIG. 5 Shows an isometric view of an optional embodiment of the Floor Tile Scoring-Cutting Guide of the triangular plate with a flat face and measurement numerals and correspondent measurement markings with a movable bar fence on one of the square right angle sides with the non-skid, non-slip surface.

20. The movable bar fence elongated on one side of the right angle triangle wherein that it extends outwardly in a ninety-degree angle from said triangular plate.

21. An indented and cut out slot on bar fence allowing for up and down movement.

22. The pinned screw in slot on the bar fence for a loose attachment to the triangular plate.

DETAILED DESCRIPTION—FIG. 1 AND FIG. 2

The basic embodiment of the Floor Tile Scoring-Cutting Guide is a triangular plate with a flat face (16) with measurement numerals (11) (15) and corresponding measurement markings (12) (14) designating distance. Right angle straightedge side (13) and diagonal straightedge side (17) of the triangular plate (16) having flat and smooth sided edges creating a straightedge for a utility knife or other such apparatus to be drawn against as a guide. On the diagonal straightedge side (17) are numeral markings (15) and horizontal and parallel markings (14) that are corresponding to the right angle straightedge side (13) designating measurement distance right angle straightedge side (13) is from the bottom of the floor tile to be sized as well as corresponding with the length of the elongated bar fence (18). A preferred embodiment, measurement markings (14) (12) and numeral markings (11) (15) optionally are recessed, indented or slightly protruding markings. Such markings (12) (14) being a minimal distance from edge of right angle and diagonal straightedge sides (13) (17). The T-bar fence (18) extends outwardly at a ninety-degree angle from the said triangular plate and face (16) only a minimal distance and only far enough that Floor Tile Scoring Guide will lie flat on floor tile to be sized. The embodiment of the Floor Tile Scoring-Cutting Guide is manufactured from any form of an integrally formed solid material, preferably constructed of hard cased aluminum.

FIG. 2 and FIG. 3—Preferred Embodiment

A preferred embodiment wherein on the face of triangular plate (16) having a non-skid and non-slide material (19) attached upon or embedded into the triangular plate and face (16) to hold Floor Tile Scoring-Cutting Guide firmly and securely in place. In the preferred embodiment of the Floor Tile Scoring-Cutting Guide it is manufactured from hard cased aluminum.

FIG. 5—Optional Bar Fence

An optional embodiment with a bar fence (20) that has an elongated squared off rectangle bar that is separate from the body of the triangular plate (16) having indented and cut out slots (21) for loose attachment to triangular plate (16) by a pinned screw (22) that can be taken out for removal of the bar fence (20).

The invention claimed is:

1. A device comprising:

a triangular plate having parallel, opposed planar faces with two right angle sides and a forty-five degree diagonal side extending between the right angle sides of the triangular plate, where at least one of the right angle side constitutes a straightedge side; and an elongated bar fence of greater thickness than the triangular plate slidably fitted disposed along a length of one of the right angle sides and projecting perpendicularly from at least one of the planar faces, where the bar fence is adjustable up and down from either planar face operable to enable the triangular plate to lay flush on a surface while the bar fence is in an up position and in a drop down position the bar fence abuts an edge of the surface, while the triangular plate lays flush on the surface, and at least one of the right angles sides and diagonal sides have numeral markings and a plurality of corresponding hash markings on at least one planar face bordering an edge of the corresponding side.

2. The device of claim 1, wherein the bar fence including at least one slot aperture, and the triangular plate having at least one pinned screw to engage the slot for attachment of the bar fence to the triangular plate.

3. The device of claim 2, wherein the bar fence is detachable from the triangular plate.

4. The device of claim 1, wherein the corresponding hash markings are set back from the straightedge side edge and a diagonal side edge to preserve smooth flat edges that are unencumbered and unobstructed from the hash markings.

5. A device comprising:

a triangular plate having opposed faces with two right angle sides and a diagonal side, where at least one right angle side being a straightedge side and the other right angle side being a bar fence side and one of the faces being flat;

an elongated bar fence extending perpendicular to at least the one flat face along at least a portion an edge of the bar fence side, at least one of the straightedge side and the diagonal side includes numeral markings and a plurality of corresponding hash markings bordering an edge of the at least one of the straightedge side and the diagonal side, the numeral markings and the hash markings bordering the diagonal side edge are parallel and horizontal to the straightedge side and designate the distance to the straightedge side; and, the triangular plate includes a non-slip material on at least the face from which the bar fence extends.

6. The device of claim 5, wherein the non-slip material is a non-slip rubber based material.

7. The device of claim 5, wherein the corresponding hash markings are set back a distance from an outer edge of the straightedge side and an outer edge of the diagonal side to provide smooth flat edges unencumbered and unobstructed from the hash markings.

8. The device of claim 5, wherein the diagonal side is at a forty-five degree angle relative to the right angle sides.

9. The device of claim 5, where at least one of the triangular plate and the bar fence is made of at least one of metal and plastic.

10. The device of claim 5, where the triangular plate and bar fence is made of aluminum.

11. The device of claim 5, where the bar fence is T shaped.

12. The device of claim 5, where the bar fence is movable perpendicular to the flat face of the triangular plate.

13. The device of claim 5, where the bar fence is removable from the triangular plate.

14. The device of claim 5, where the bar fence extends along the entire edge of the bar fence side.

15. The device of claim 5, where the bar fence extends from only one of the faces.

16. A device comprising:

a triangular plate having parallel, opposed planar faces with two right angle sides and one forty-five degree diagonal side extending between the right angle sides of the triangular plate whereas one right angle side constitutes a straightedge side having an edge; and an elongated bar fence of greater thickness than the triangular plate integrally incorporated with the triangular plate disposed along a length of one right angle side horizontally aligned and projecting perpendicularly from at least one planar face having a predetermined raised edge of a minimal distance of commensurable height to accommodate abutment of a VCT floor tile to the bar fence, where the bar fence thickness relative to the triangular plate being limited to a thickness of the VCT floor tile to enable the triangular plate to lay flush and securely upon on the tile when the bar fence is abutted to an edge of the VCT floor tile, the straightedge side including numeral markings and a plurality of corresponding perpendicular hash markings on at least one planar face bordering an outer edge, whereby hash markings designate distance from the other right angle side, and the diagonal side including numeral markings and a plurality of corresponding hash markings on at least one planar face, whereby the hash markings are parallel and horizontal to adjacent the straightedge side.

17. The device of claim 16, wherein the corresponding hash markings on the planer face are set back a distance from the straightedge side edge and the diagonal side edge to provide smooth flat edges unencumbered and unobstructed from the hash markings.

18. The device of claim 16, wherein the numeral markings and the corresponding hash markings bordering the diagonal side edge designate distance from the right angle sides.

* * * * *